US008967375B1

(12) United States Patent
Nitkin

(10) Patent No.: US 8,967,375 B1
(45) Date of Patent: Mar. 3, 2015

(54) FOLD UP LUGGAGE FOR ELONGATE ITEMS

(71) Applicant: Andrew Nitkin, New York, NY (US)

(72) Inventor: Andrew Nitkin, New York, NY (US)

(73) Assignee: Athalon Sportsgear, Inc., New York, NY (US)

( * ) Notice: Subject to any disclaimer, the term of this patent is extended or adjusted under 35 U.S.C. 154(b) by 194 days.

(21) Appl. No.: 13/661,151

(22) Filed: Oct. 26, 2012

Related U.S. Application Data

(60) Provisional application No. 61/552,053, filed on Oct. 27, 2011.

(51) Int. Cl.
*B62D 1/14* (2006.01)
*A63B 71/00* (2006.01)
*A63B 55/00* (2006.01)

(52) U.S. Cl.
CPC ..... *A63B 71/00* (2013.01); *A63B 55/00* (2013.01)
USPC ..... 206/315.2; 206/315.1; 206/315.11; 206/315.4; 206/349; 206/579; 190/103; 190/105; 190/107; 190/108; 190/111; D3/201; D3/246; D3/254; D3/255; D3/261; 280/47.26; 280/655.1; 280/814; 224/153; 224/250

(58) Field of Classification Search
USPC ..... 206/315.1, 315.2, 315.11, 315.4, 349, 206/579, 8; 190/103, 105, 107, 108, 111, 190/114, 18 A; 224/153, 250, 328, 580, 224/601, 607, 613; 280/47.26, 655.1, 814; D3/201, 246, 254, 255, 261, 279
See application file for complete search history.

(56) References Cited

U.S. PATENT DOCUMENTS

2008/0023356 A1* 1/2008 Manaster et al. ..... 206/315.3
2011/0031081 A1* 2/2011 Iceberg et al. ..... 190/125

* cited by examiner

*Primary Examiner* — Fenn Mathew
*Assistant Examiner* — Cynthia Collado
(74) *Attorney, Agent, or Firm* — Edell, Shapiro & Finnan, LLC

(57) ABSTRACT

A travel case for elongate items such as skis, golf clubs, snowboards, or the like comprises an elongate bag having a pair of hard sided end sections longitudinally spaced from a hard sided center section. Between each end section and the center section is a respective soft sided intermediate section. The hard sided end and center sections provide protection for the case contents at the vulnerable locations of those contents. The soft sided intermediate sections, made of collapsible and supple material, provide the advantage of reducing the weight of the overall case, and the suppleness permits the end sections to be folded in on the center section when the case is open along its length to educe the length and the required storage space for the case when not in use.

15 Claims, 12 Drawing Sheets

FOLD UP LUGGAGE FOR ELONGATE ITEMS

CROSS REFERENCE TO RELATED APPLICATION

This application claims priority from U.S. Provisional Patent Application Ser. No. 61/552,053 entitled "Fold Up Luggage For Elongate Items," filed Oct. 27, 2011. The disclosure of this provisional patent application is incorporated herein by reference in its entirety.

BACKGROUND

The present invention pertains to a case for protecting elongate items during travel. More particularly, the invention pertains to a travel bag for items such as golf clubs, skis, ski boards, and the like.

Golf clubs, skis, ski boards, and the like, are susceptible to damage during travel. The two primary types of travel luggage or cases for protecting such item may be characterized as the soft sided case and the hard sided case. Soft sided cases are lightweight, readily carried about, and collapsible into a relatively small size when not in use. However, soft sided cases are not capable of providing significant protection for golf clubs or skis or other contents of the case while traveling because they do not protect against impact and bending forces and are too easily torn, all of which exposes the golf clubs to damage.

Hard sided travel cases provide significantly more protection, but the weight and size of hard sided cases are disadvantageous. Moreover, hard sided travel cases are not compressible and therefore take up a lot of storage space which is undesirable for the consumer and for retail stores, not to mention the added difficulties and cost of space and weight during shipping.

Although the primary embodiment is described herein in terms of a travel case for skis, it is understood that the principles of the invention apply to cases for golf clubs, ski boards and other similarly sized elongate items that require protection during transportation.

SUMMARY

In accordance with the present invention a travel case for skis, golf clubs or the like comprises an elongate bag or case having a pair of hard sided end sections longitudinally spaced from a hard sided center section. Between each end section and the center section is a respective soft sided intermediate section. The hard sided end and center sections provide protections for the case contents, particularly at the more vulnerable locations of those contents in the case. The soft sided intermediate sections, made of collapsible and supple material, provide the advantage of reducing the weight of the overall case as compared to the weight of a fully hard sided case of the same length. In addition, the suppleness of the soft sided sections permit the end sections to be folded in on the center section when the case is open along its length to thereby reduce the length and the required storage space for the case when not in use.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
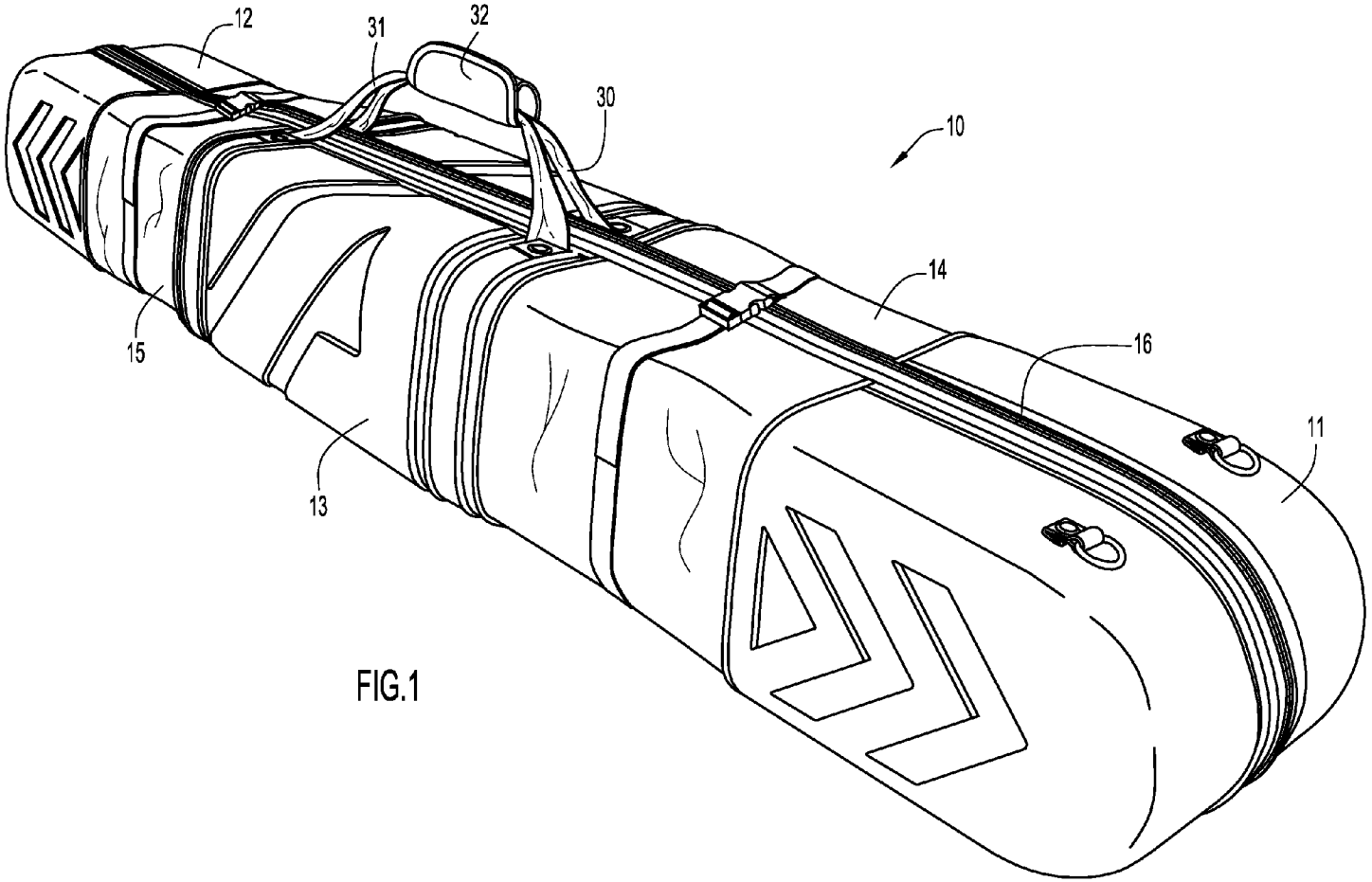
FIG. 1 is a view in perspective of a travel case according to one embodiment of the present invention shown unfolded and closed as it appears in use.
Figure 2:
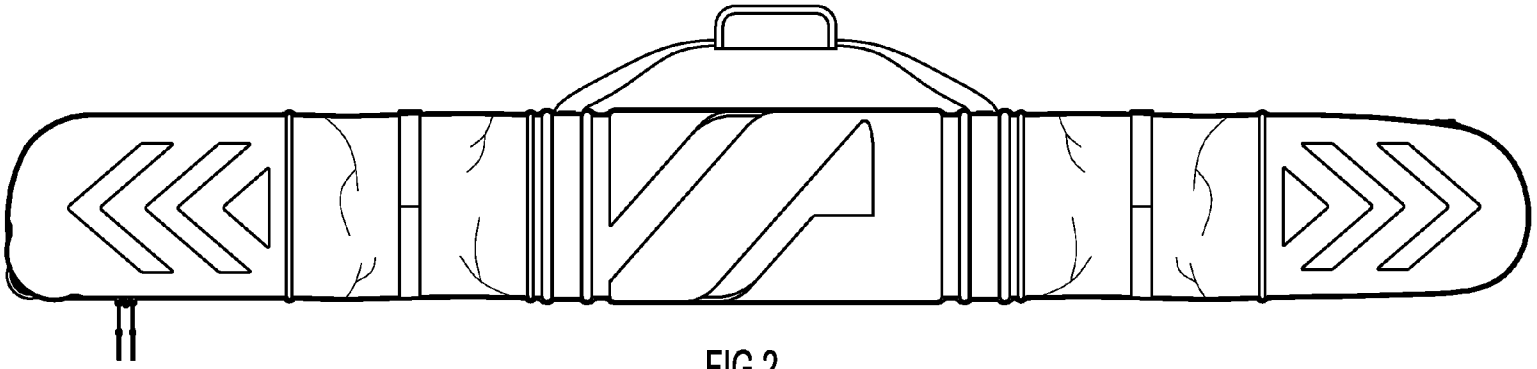
FIG. 2 is a left side view in elevation of the case shown in FIG. 1.
Figure 3:
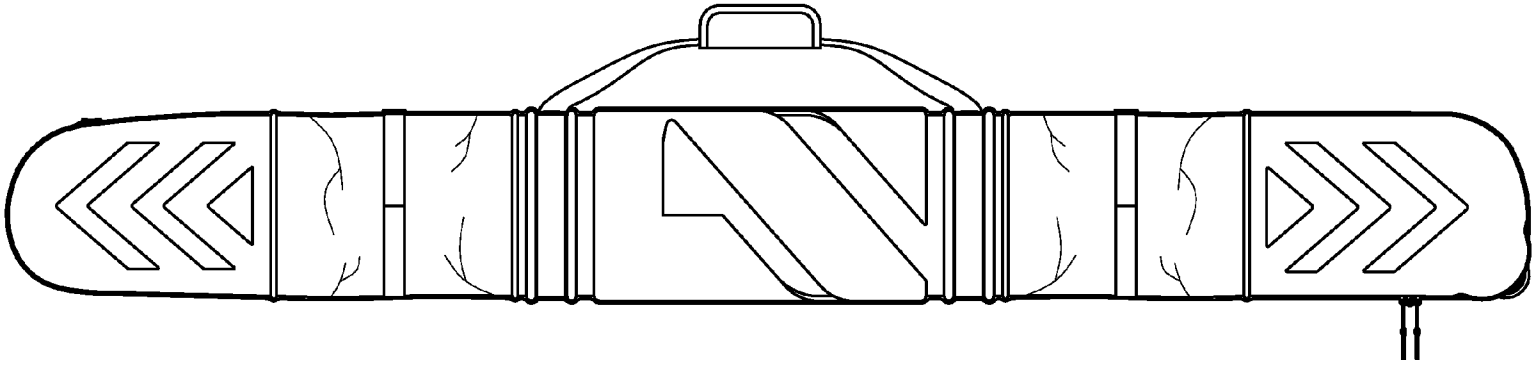
FIG. 3 is a right side view in elevation of the case shown in FIG. 1.
Figure 4:
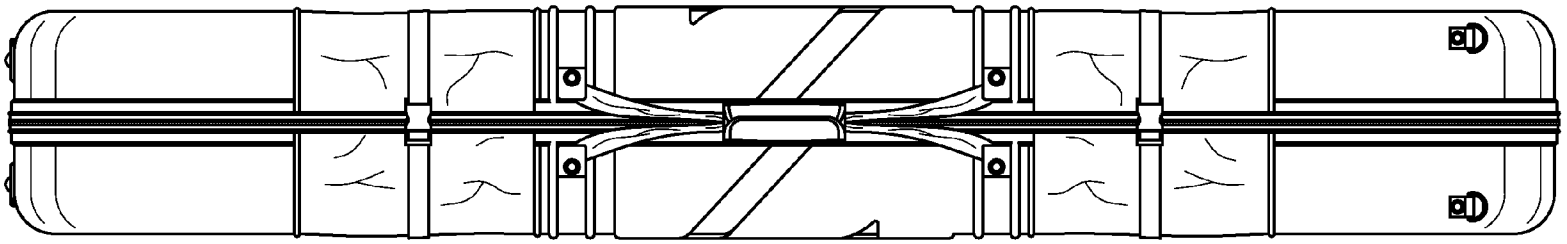
FIG. 4 is a front view in plan of the case shown in FIG. 1.
Figure 5:
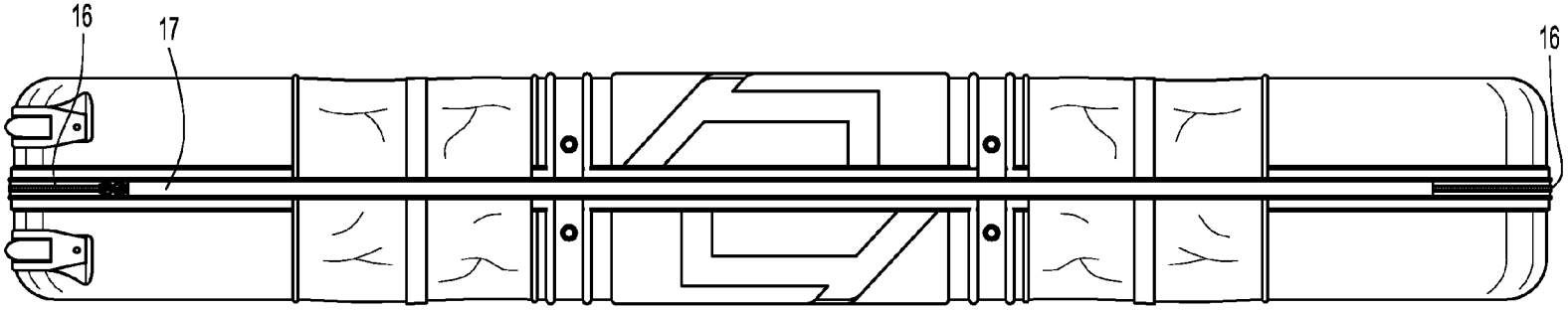
FIG. 5 is a rear view in plan of the case shown in FIG. 1.
Figure 7:
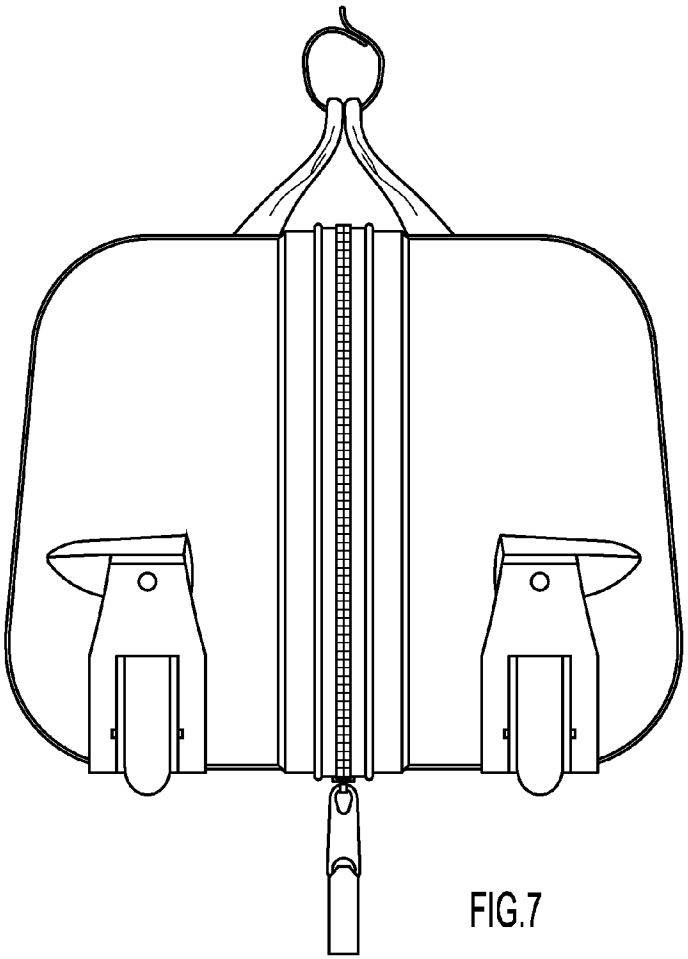
FIG. 7 is a bottom end view of the case shown in FIG. 1.
Figure 6:
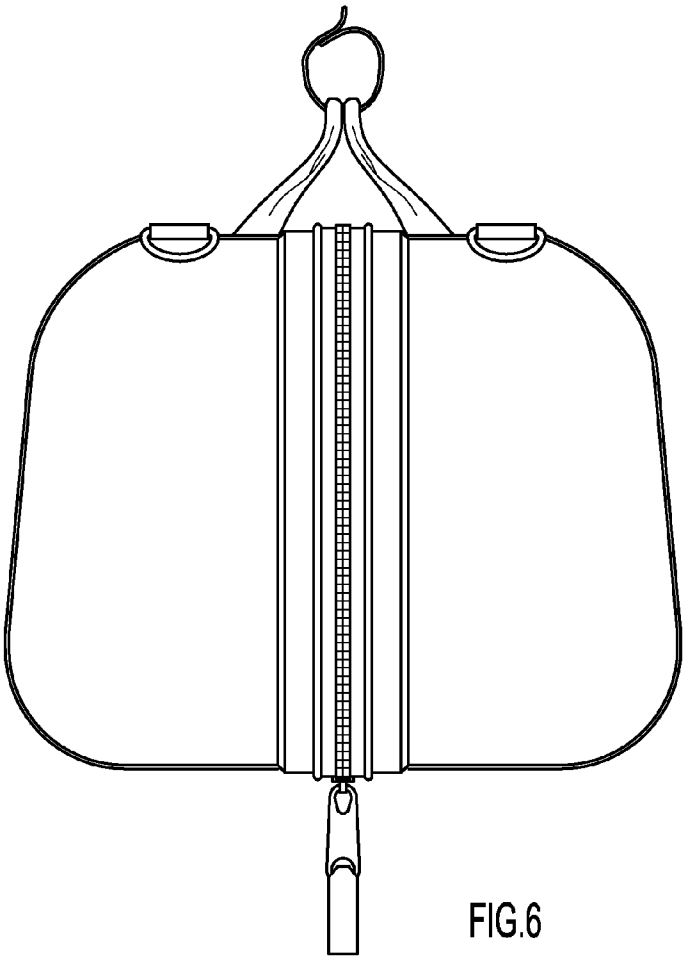
FIG. 6 is a top end view in plan of the case shown in FIG. 1.
Figure 8:
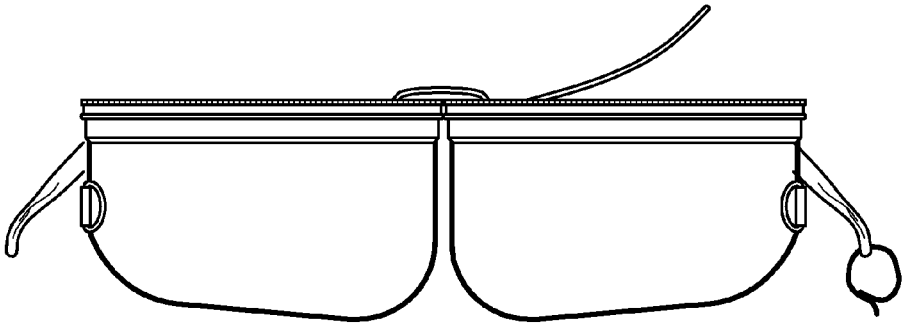
FIG. 8 is a top end view in plan of the case of FIG. 1 shown unfolded and open as it appears in use when its contents are being loaded or unloaded.
Figure 9:
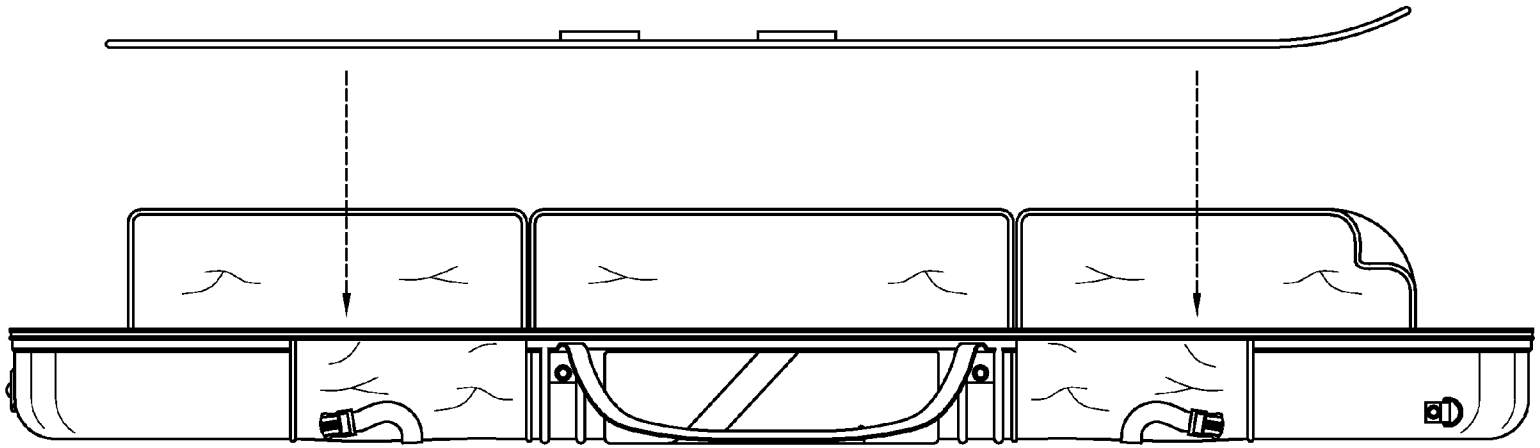
FIG. 9 is a left side view in elevation of the case shown in FIG. 8 diagrammatically illustrating contents being loaded in the case.
Figure 10:
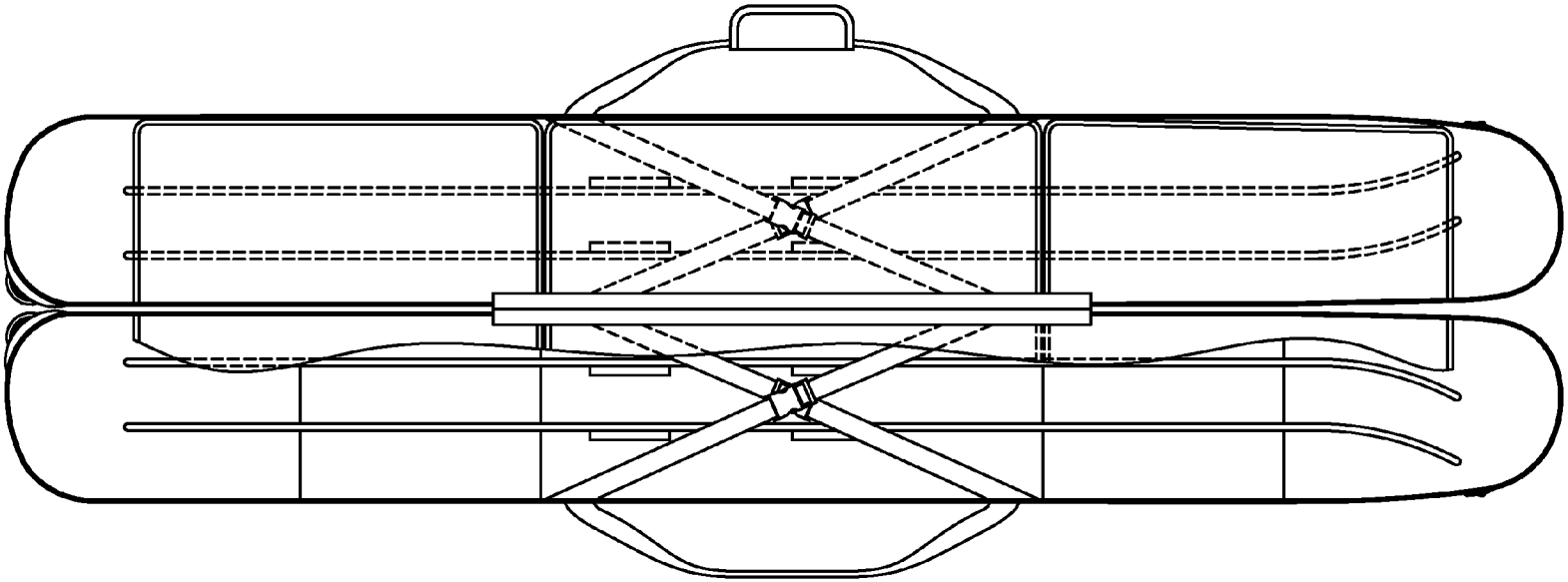
FIG. 10 is a front view in plan of the case shown in FIG. 8 with contents loaded therein.
Figure 11:
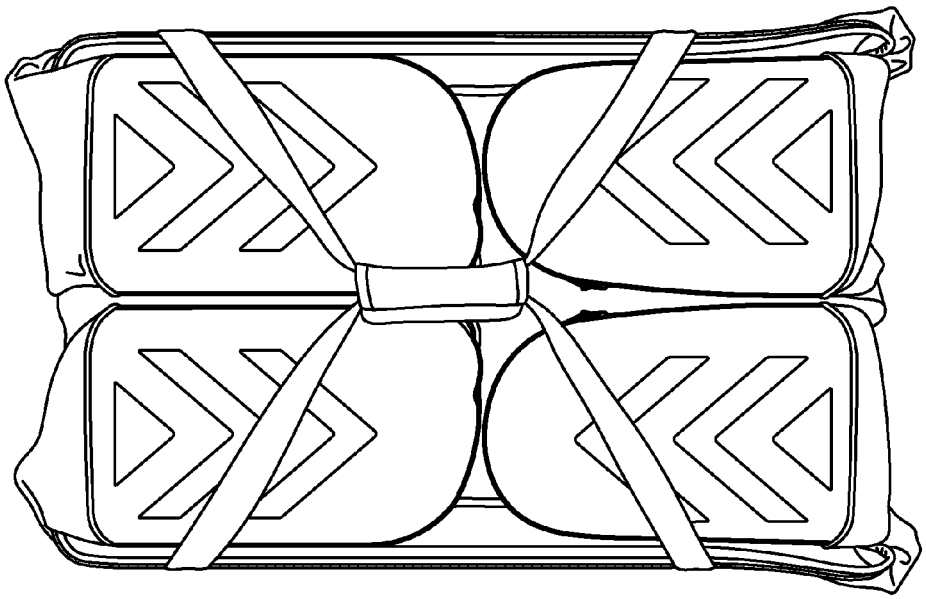
FIG. 11 is a front view in plan of the case of FIGS. 1 and 8 showing the case folded and secured for storage or display.
Figure 12:
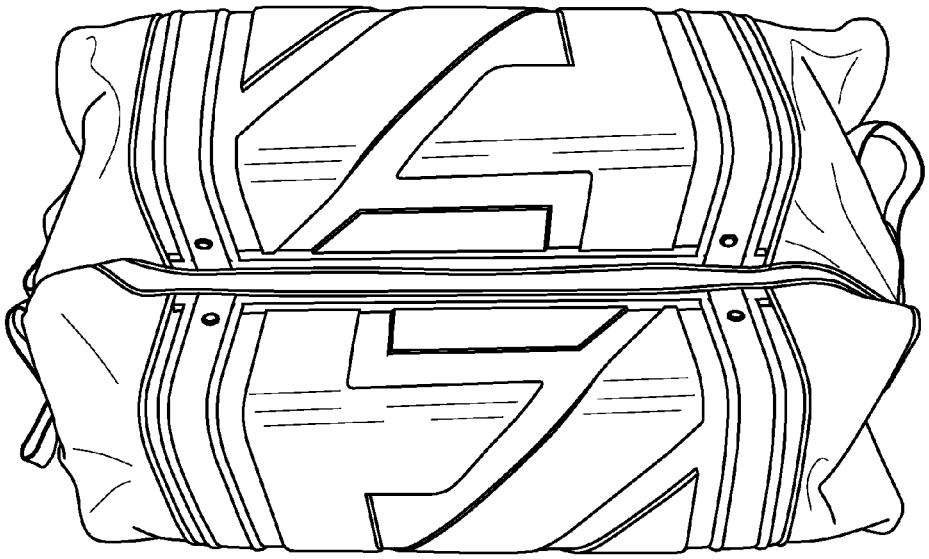
FIG. 12 is a rear view in plan of the case shown in FIG. 11.

The following detailed explanations of the drawings and the preferred embodiments reveal the methods and apparatus of the present invention.

Referring more specifically to FIGS. 1-7 the drawings, an elongate travel bag or case 10 for transporting skis, golf clubs, or the like, is shown in closed condition. Case 10 includes a hard sided top end section 11, a hard sided bottom end section 12, each longitudinally spaced from a hard sided center section 13. Between top end section 10 and center section 13 is a soft sided upper intermediate section 14; likewise, a soft lower intermediate section 15 is disposed between center section 13 and bottom section 12. Hard sided sections 11, 12 and 13 are made from a material that is sufficiently rigid and hard to resist breakage and deformation in response to the type of impact experienced when the case is dropped or otherwise mishandled during travel and transport of the case with or without internal contents. This material is preferably a hard lightweight molded polymer such as ABS or polycarbonate and may be additionally reinforced with a lattice or strands of an impregnated metal such as platinum. In the preferred embodiment the material has a hardness (Durometer) value of approximately 75 D on the Shore D scale and would typically have a hardness in the range of 65 D to 85 D. Soft sided intermediate sections 14 and 15 are made of a strong supple material that is resistant to penetration and water but collapsible; such material may be, for example, ballistic nylon but it may alternatively be other supple materials having similar abrasion and tear resistant properties. In the preferred embodiment the soft sided material has a hardness (Durometer) value of 30 A on the Shore A scale and would typically have a hardness in the range of 20 A to 40 A. As noted, the soft sided intermediate sections provide the advantage of reducing the weight of the overall case as compared to the weight of a fully hard sided case of the same length. In addition, as described herein, the soft sided sections 14, 15 permit the end sections 11, 12 to be folded in on the center section 13 when the case is open along its length to thereby reduce the length and the required storage space for the case when not in use.

The interior of the case 10 is lined with a soft lining, preferably a nylon fabric, secured in a conventional manner on the interior surfaces of the outer walls of the casing sections. The lining and the interior surfaces enclose foam panels by stitching, or the like, in a sandwich construction, the foam panels preferably being made of any suitable padding material such as cross-linked polyethylene foam.

The case 10 is formed as two mirror image components or halves that are joined along the back of the case by a strip 17 of rugged pliable fabric serving as a pivot hinge between the two halves. By way of example, strip 17 may be made, of a durable abrasion resistant vinyl fabric. Strip 17 extends longitudinally between a lower portion of the top section 11 and an upper portion of the bottom section 12 and, is so doing, pivotally joins the halves of each of those sections, the center section 13 and the intermediate sections 14, 15. A conventional zipper assembly 16 extends longitudinally between the ends of strip 17, passing over the top section 10, the bottom section 11 and along the entire front of the case. The zipper permits selective opening and closing of the case. Strip 17 and zipper assembly 16 are typically secured by stitching or the like to interior lining in the case 10.

Strap handles 30, 31 are secured to respective halves of center section 13 adjacent the zipper assembly and may be held in adjacency by a grip 32 in a conventional manner.

Figure 13:
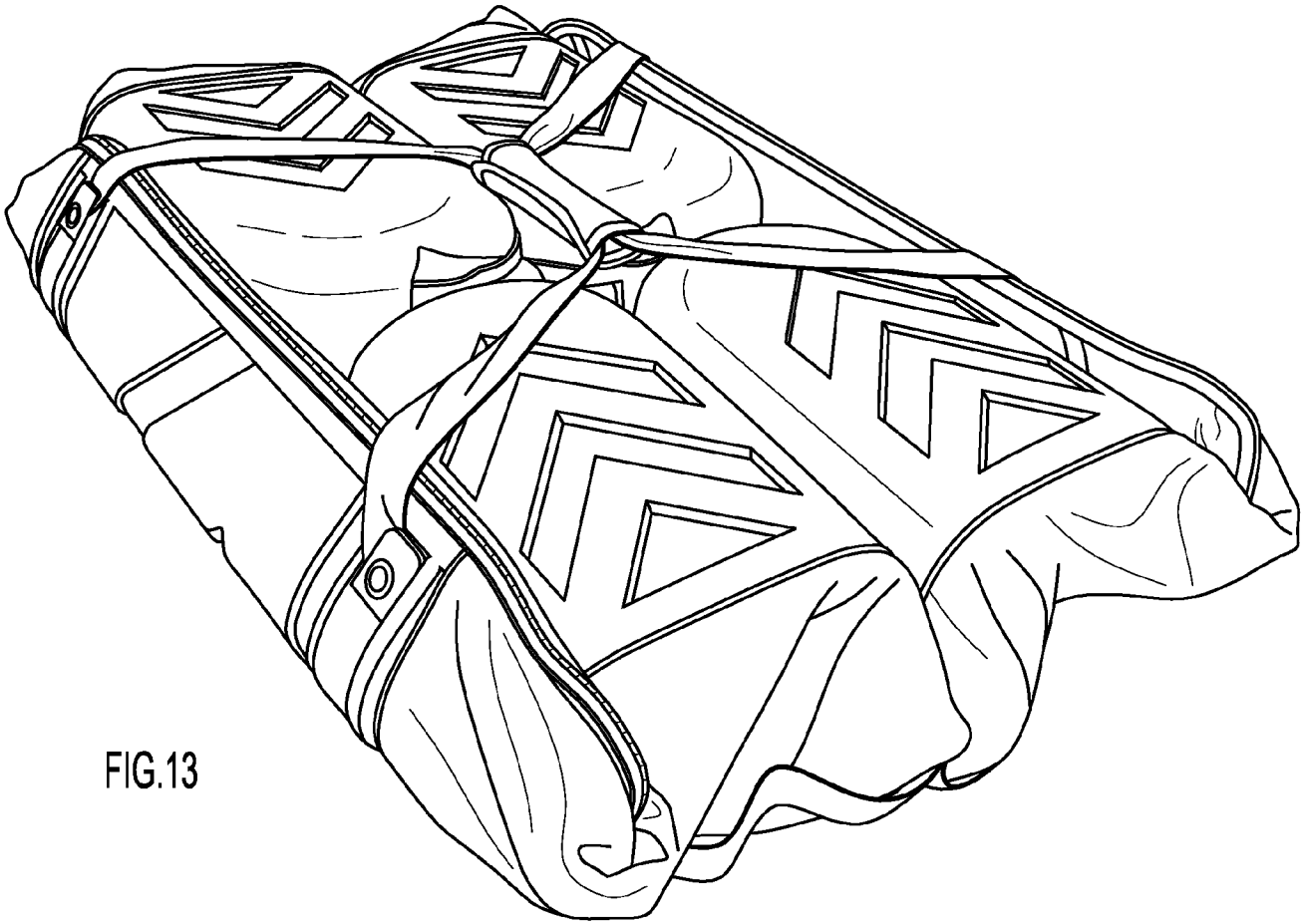
FIG. 13 is a view in perspective of the case shown in FIG. 11.
Figure 14:
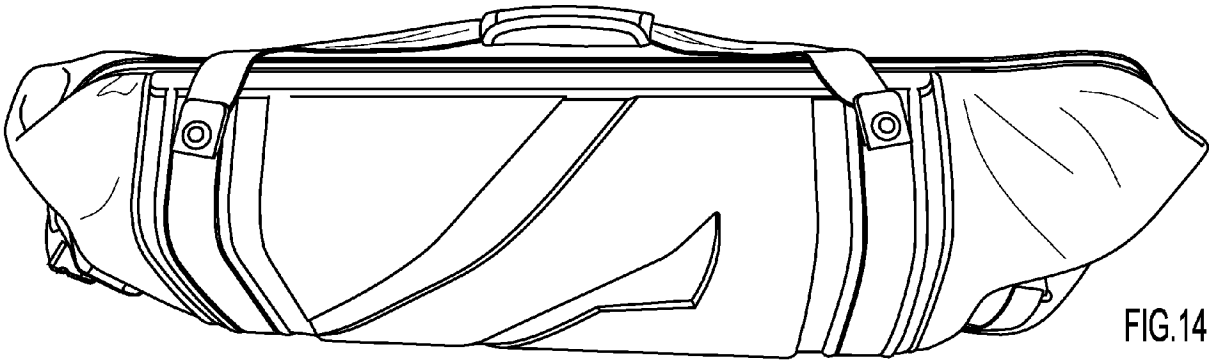
FIG. 14 is a left side view in elevation of the case shown in FIG. 11.
Figure 15:
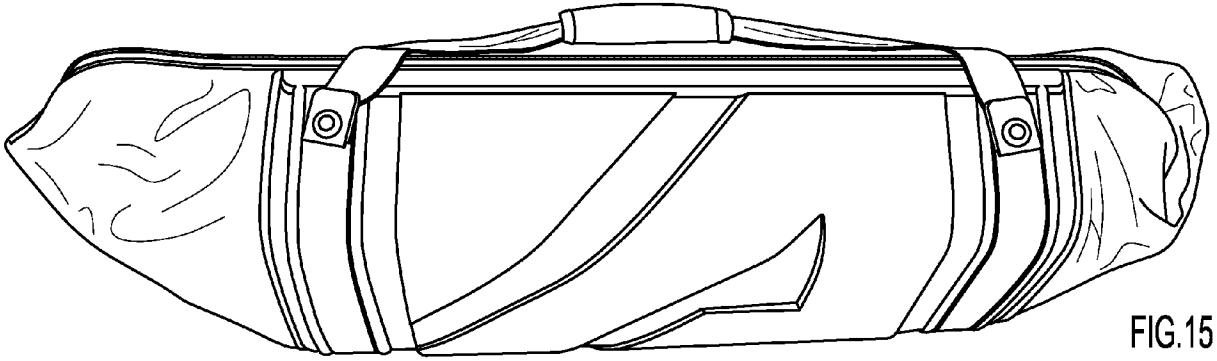
FIG. 15 is a right side view in elevation of the case shown in FIG. 11.
Figure 16:
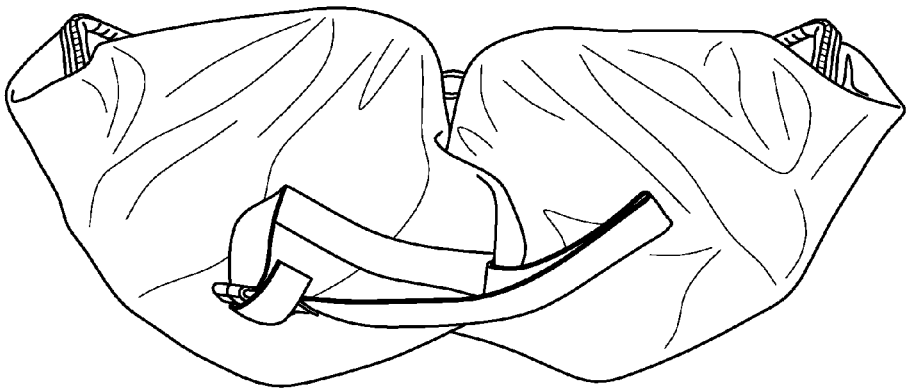
FIG. 16 is a top end view in plan of the case shown in FIG. 11.
Figure 17:
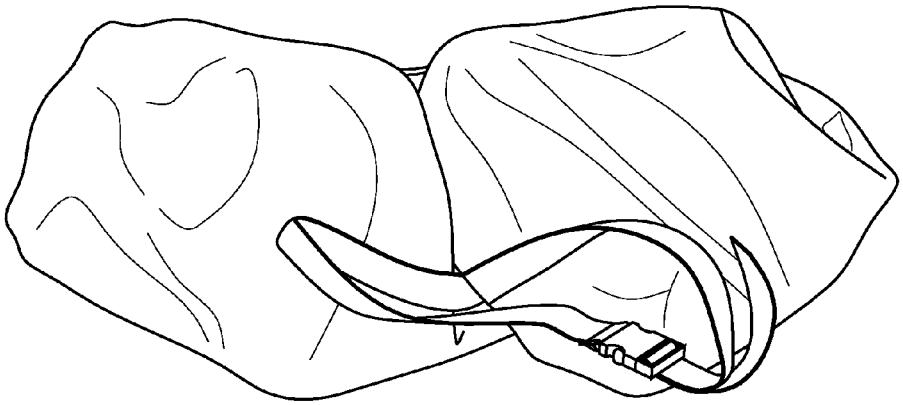
FIG. 17 is a bottom end vies in plan of the case shown in FIG. 11.
Figure 18:
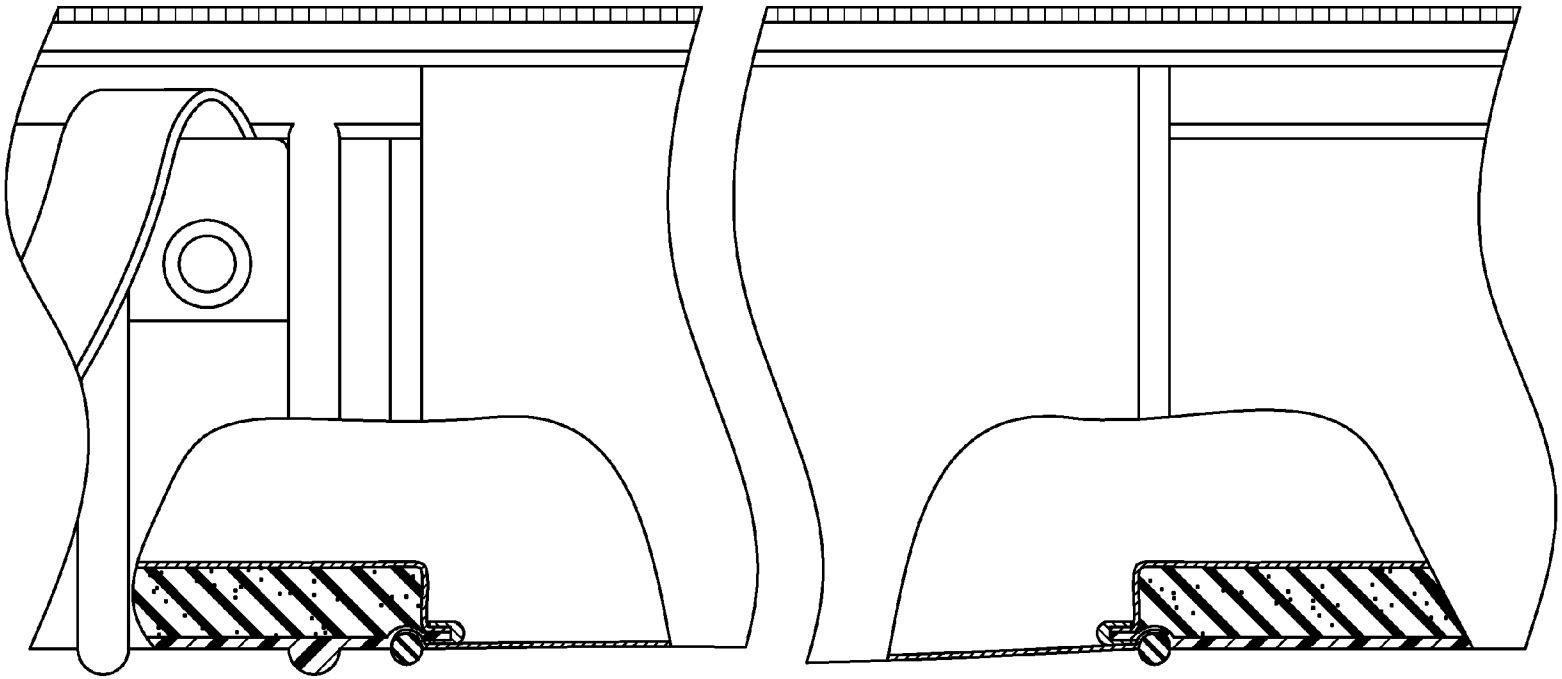
FIG. 18 is a detailed longitudinal view in partial section of a portion of the case the case shown in FIG. 1 showing interior lining and padding.

When the case is not in use it can be opened by actuating the zipper assembly 16 to expose, face up, the two case halves. The top section of each half can be folded over onto a portion of the center section of that half using the upper intermediate section as an loosely defined hinge. Likewise, bottom section of each half can be folded over onto a portion of the center section of that half using the lower intermediate section as a loosely defined hinge. When so folded the upper ends of the top section halves reside in close adjacency to the lower ends of the bottom section halves. In this condition, as best illustrated in FIG. 13, handle straps 30, 31 may be joined by grip 32 to maintain the folded sections in place and to provide and an appropriate handgrip for lifting and moving the unit as necessary. This configuration of the unit, wherein the sections are folded in thirds, permits the case to be stored in a minimum amount of space and stacked with other like units in a warehouse or retail store.

When the case 10 contains skis, golf clubs, ski boards, or other elongated rigid items, these items themselves contact the upper and lower sections inside the case to extend and support the case longitudinally and prevent the soft intermediate sections from collapsing. The hard and rigid material of top section 11, bottom section 12 and center section 13 protect the contained items from damage. When the contained items are removed the case can be folded for storage as described above. Alternatively, since the unit collapses longitudinally at the intermediate sections when empty, the case can be stood up in a closet or the like and occupy less vertical space than would be required by a conventional hard sided case.

Wheels are provided at the lower end of the bottom section 12 to facilitate carrying of the case.

Having described preferred embodiments of new and improved Fold Up Luggage For Elongate Items, it is believed that other modifications, variations and changes will be suggested to those skilled in the art in view of the teachings set forth herein. It is therefore to be understood that all such variations, modifications and changes are believed to fall within the scope of the present invention. Although specific terms are employed herein, they are used in a generic and descriptive sense only and not for purposes of limitation.

What is claimed is:

1. A travel case for elongate items in the form of an elongate bag or case comprising:

a pair of hard sided end sections longitudinally spaced from a hard sided center section;

respective soft sided intermediate sections disposed between each end section and the center section;

wherein the hard sided end and center sections provide protection for the case contents, particularly at vulnerable locations of those contents in the case;

wherein the soft sided intermediate sections are made of collapsible and supple material to provide an advantage of reducing weight of the case as compared to weight of a fully hard sided case of similar length;

wherein the suppleness of the soft sided sections permit the end sections to be folded in on the center section when the case is open along its length to thereby reduce the length and the required storage space for the case when not in use; and wherein the case is formed as two mirror image components or halves that are joined along a back of the case by a strip of rugged pliable fabric serving as a pivot hinge between the two halves.

2. The travel case of claim 1 wherein the strip is made of a durable abrasion resistant vinyl fabric that extends longitudinally between a lower portion of one end section and an upper portion of the other end section to pivotally join the halves of each of those sections, the center section and the intermediate sections.

3. The travel case of claim 2 further comprising a zipper assembly extending longitudinally between the ends of the strip passing over the end sections and along the entire front of the case to permit selective opening and closing of the case.

4. The travel case of claim 1 wherein the end sections and center section are made from a hard material that is sufficiently rigid to resist breakage and deformation in response to impact experienced when the case is dropped or otherwise mishandled during travel and transport.

5. The travel case of claim 4 wherein the hard material is a lightweight molded polymer reinforced with strands of an impregnated metal.

6. The travel case of claim 4 wherein the hard material has a hardness (Durometer) value in the range of 65 D to 85 D on the Shore scale.

7. The travel case of claim 6 wherein the soft sided intermediate sections are made of a strong supple material that is resistant to penetration and water but collapsible, and has a hardness (Durometer) on the Shore A scale in the range of 20 A to 40 A.

8. The travel case of claim 7 wherein the strong supple material is ballistic nylon.

9. The travel case of claim 1 wherein the interior of the case is lined with a soft fabric secured on the interior surfaces of the outer walls of the case sections, and wherein the lining and the interior surfaces enclose foam panels in a sandwich construction, the foam panels being made of padding material such as cross-linked polyethylene foam.

10. A travel case for elongate items in the form of an elongate bag or case comprising:

a pair of hard sided end sections longitudinally spaced from a hard sided center section;

respective soft sided intermediate sections disposed between each end section and the center section;

wherein the hard sided end and center sections provide protection for the case contents, particularly at vulnerable locations of those contents in the case;

wherein the soft sided intermediate sections are made of collapsible strong supple material that is resistant to penetration and water to provide advantages of being resistant and of reducing weight of the case as compared to weight of a fully hard sided case of similar length; and wherein the case is formed as two mirror image components or halves that are joined along a back of the case by a strip of pliable material serving as a pivot hinge between the two halves.

11. The travel case of claim 10 further comprising a zipper assembly extending longitudinally between the ends of the strip passing over the end sections and along the entire front of the case to permit selective opening and closing of the case.

12. The travel case of claim 10 wherein the strip is made of a durable abrasion resistant vinyl fabric that extends longitudinally between a lower portion of one end section and an upper portion of the other end section to pivotally join the halves of each of those sections, the center section and the intermediate sections.

13. The travel case of claim 10 wherein the end sections and center section are made from a hard material that is sufficiently rigid to resist breakage and deformation in response to impact experienced when the case is dropped or otherwise mishandled during travel and transport, wherein the hard material is a lightweight molded polymer reinforced with strands of an impregnated metal, and wherein the hard material has a hardness (Durometer) value in the range of 65 D to 85 D on the Shore scale.

14. The travel case of claim 13 wherein the soft sided intermediate sections are made of a strong supple material that has a hardness (Durometer) on the Shore A scale in the range of 20 A to 40 A.

15. The travel case of claim 10 wherein the interior of the case is lined with a soft fabric secured on the interior surfaces of the outer walls of the case sections, and wherein the lining and the interior surfaces enclose foam panels in a sandwich construction, the foam panels being made of padding material such as cross-linked polyethylene foam.

* * * * *